US005871281A

United States Patent [19]

Stolmeier et al.

[11] Patent Number: 5,871,281

[45] Date of Patent: Feb. 16, 1999

[54] ZIPPER SLIDER PIVOTING WEDGE

[75] Inventors: Robert C. Stolmeier; Thomas P. O'Connor, both of Shelbyville, Ind.

[73] Assignee: KCL Corporation, Shelbyville, Ind.

[21] Appl. No.: 758,170

[22] Filed: Nov. 25, 1996

[51] Int. Cl.[6] ..... B65D 33/24

[52] U.S. Cl. ..... 383/64; 24/417; 24/427; 24/430

[58] Field of Search ..... 383/64; 24/587, 24/417, 427, 428, 430

[56] References Cited

U.S. PATENT DOCUMENTS

| | | | |
|---|---|---|---|
| 2,994,469 | 8/1961 | Troup et al. . | |
| 3,122,807 | 3/1964 | Ausnit . | |
| 3,426,396 | 2/1969 | Laguerre | 24/427 |
| 3,660,875 | 5/1972 | Gutman | 24/427 |
| 5,007,142 | 4/1991 | Herrington . | |
| 5,007,143 | 4/1991 | Herrington . | |
| 5,010,627 | 4/1991 | Herrington et al. . | |
| 5,020,194 | 6/1991 | Herrington et al. . | |
| 5,063,644 | 11/1991 | Herrington et al. . | |
| 5,067,208 | 11/1991 | Herrington, Jr. et al. . | |
| 5,131,121 | 7/1992 | Herrington, Jr. et al. . | |
| 5,211,482 | 5/1993 | Tilman . | |
| 5,283,932 | 2/1994 | Richardson et al. . | |
| 5,293,671 | 3/1994 | Oda . | |
| 5,301,394 | 4/1994 | Richardson et al. . | |
| 5,425,825 | 6/1995 | Rasko et al. . | |
| 5,426,830 | 6/1995 | Richardson | 24/430 |
| 5,435,864 | 7/1995 | Machacek et al. . | |
| 5,442,837 | 8/1995 | Morgan . | |
| 5,442,838 | 8/1995 | Richardson et al. . | |
| 5,456,928 | 10/1995 | Hustad et al. . | |
| 5,482,375 | 1/1996 | Richardson et al. . | |
| 5,492,411 | 2/1996 | May . | |
| 5,664,299 | 9/1997 | Porchia et al. | 24/587 |

*Primary Examiner*—Stephen P. Garbe
*Attorney, Agent, or Firm*—Woodard, Emhardt, Naughton, Moriarty & McNett

[57] ABSTRACT

A plastic bag closer slider has a separator normally resting in notches in the tops of slider track strips, when the slider is at a bag-closed stop. As the slider is moved in the bag-opening direction, the separator is cammed downward by ends of the notches to disengage interlocking profile features and open the tag. In another embodiment, notches are omitted. The separator is manufactured with a normally down position but is resiliently biased upward when the bag is closed. As the slider is moved in the bag-opening direction, the pointed end of the separator wedge descends between the strips to open the bag. When the slider is moved in the bag-closing direction, the separator is cammed upward by the drag of the strip tops and the tapering walls of the slider squeeze interlocking profile features together, closing the bag.

28 Claims, 9 Drawing Sheets

ZIPPER SLIDER PIVOTING WEDGE

BACKGROUND OF THE INVENTION

1. Field of the Invention

This invention relates generally to reclosable plastic bags with closing zippers, and more particularly to zipper slider features thereof.

2. Description of the Prior Art

Various inventions have been made in the field of zipper-type closures for plastic bags. A problem encountered with some such closures has been the inadvertent separation of the slider from the bag. Another is unreliable opening or closing of the bag, and undue wear on certain features. To assist in the opening of some bags, some type of separator has been used. However, even when the bag is closed, the separator remains in place, enabling certain types of contents, such as powders and liquids, to spill out. One technique which has been used in an effort to overcome this problem, is to provide a notch in the tracks in which the separator can be received when the slider is at the bag-closing end of the tracks, thereby enabling the tracks to be completely closed without the separator maintaining a force in the tracks tending to open the bag. But the problem with such a notch is that it is difficult to make exactly the right length and depth, and it is difficult to install the slider exactly in place over the notch. If any of these elements occurs out of precise tolerance, then the slider will fail to operate properly. While some such efforts have been made in the slide tracks and slider to overcome such problems, the present invention is addressed to further improvement.

SUMMARY OF THE INVENTION

Described briefly, according to one embodiment of the invention, a flexible bag has a zipper-type closure with flexible strips attached to the bag walls, the strips having interlocking rib and groove profiles, and a slider. The slider is movable in one direction longitudinally of the strips to progressively separate the rib from the groove to open the bag, and is movable in the opposite direction to progressively return the rib to retained condition in the groove to close the bag. The slider has a separator normally situated in a rest position in the tops of the strips, when the slider is in a bag-closed stop location. As the slider is moved in the bag-opening direction, the separator pivots downward to disengage the interlocking profile features and open the bag. When the slider is moved in the bag-closing direction, the separator is cammed upward by the strip tops until it rides atop the strips, and the tapering walls of the slider squeeze the interlocking profile features together, closing the bag. A guide pin on the slider guides the slider to a desired point, without opening the bag.

DESCRIPTION OF THE PREFERRED EMBODIMENT

Figure 1:
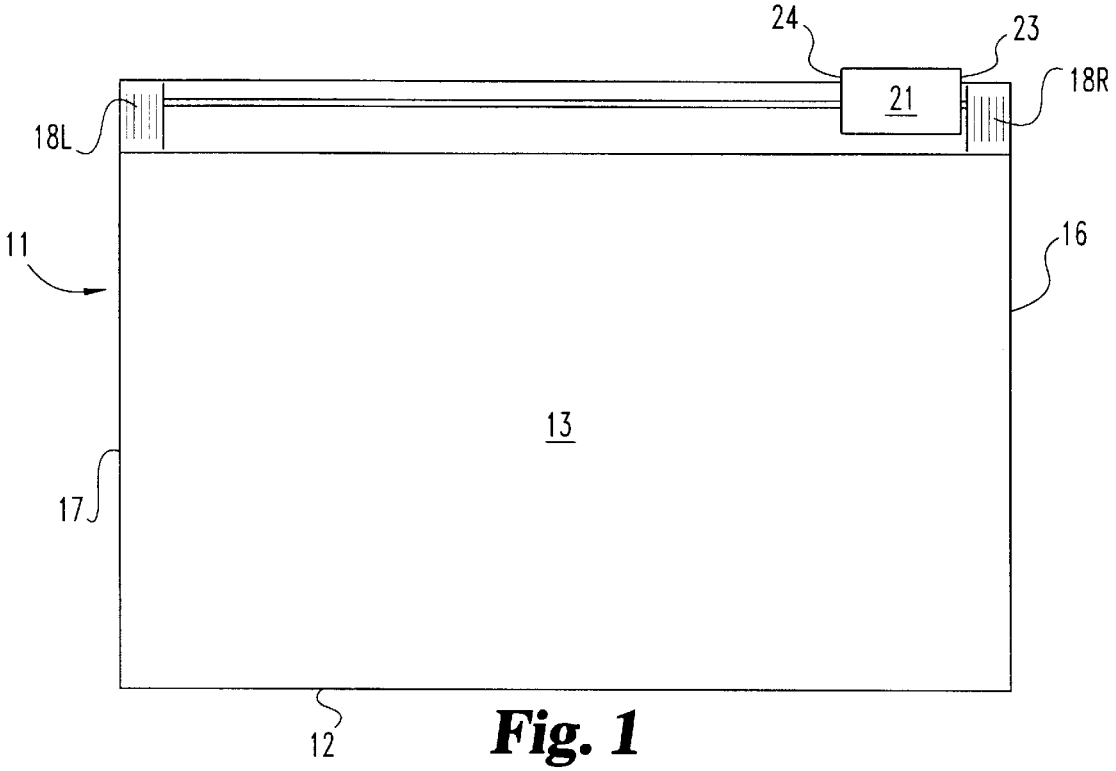
FIG. 1 is a front elevational view of a reclosable plastic bag with a zipper assembly according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
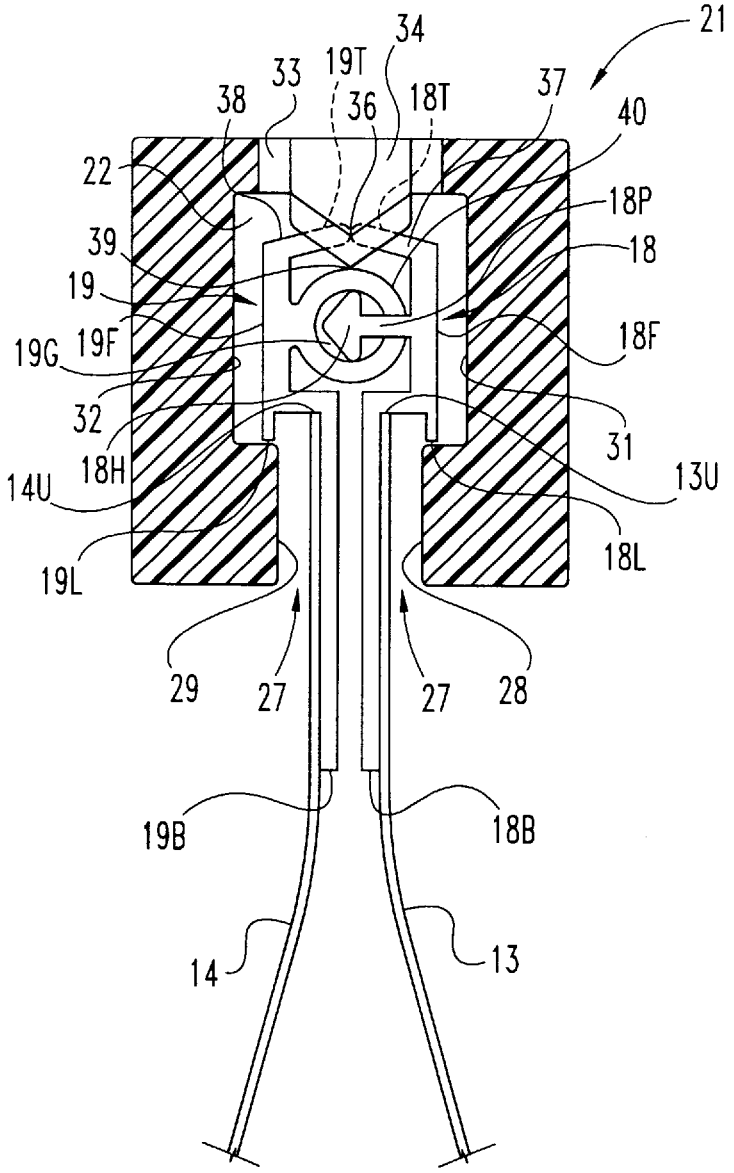
FIG. 4 is a much-enlarged cross sectional view taken at line 4—4 in FIG. 2 and viewed in the direction of the arrows.

Referring now to the drawings in detail, a plastic bag 11 of conventional construction may be a sheet of polyethylene folded along the line 12 providing front and rear walls 13 and 14 (FIG. 4) sealed at the right-hand edge 16 and left-hand edge 17 by heat, ultrasonic or other type of sealing means. The marginal portions near the upper edges 13U and 14U are sealed by heat, ultrasonic welding or otherwise to base flanges 18B and 19B of elongated flexible plastic strips 18 and 19 at the front and rear bag walls. These strips are crimped and sealed at the right-hand end 18R and left-hand end 18L to the top of the bag and to each other. These strips which are typically made of extruded plastic have complementary profiles in which a portion of the rear strip 19 forms a groove 19G therein which interlockingly receives the rib 18P with flanged head 18H of an arrow-shaped cross section profile portion in strip 18. Since the groove is C-shaped, after the faces 18F and 19F are forced toward each other, forcing the head into the groove, the strips will remain together, with the groove resiliently holding the rib head snugly in the groove, sealing the bag closed. In this condition, the strip upper flange edges 18T and 19T (FIG. 10) touch each other and supplement the coupling of the rib head with the groove in providing a secondary closure of the top of the bag assembly.

Figure 11:
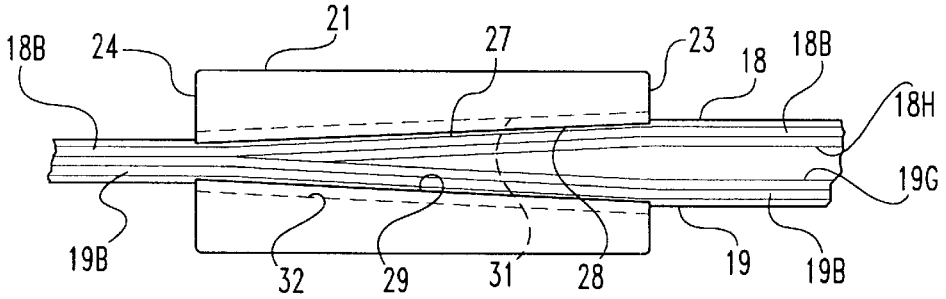
FIG. 11 is a sectional view taken at line 11—11 in FIG. 9 and viewed in the direction of the arrows to show the tapering walls of the slider.
Figure 12:
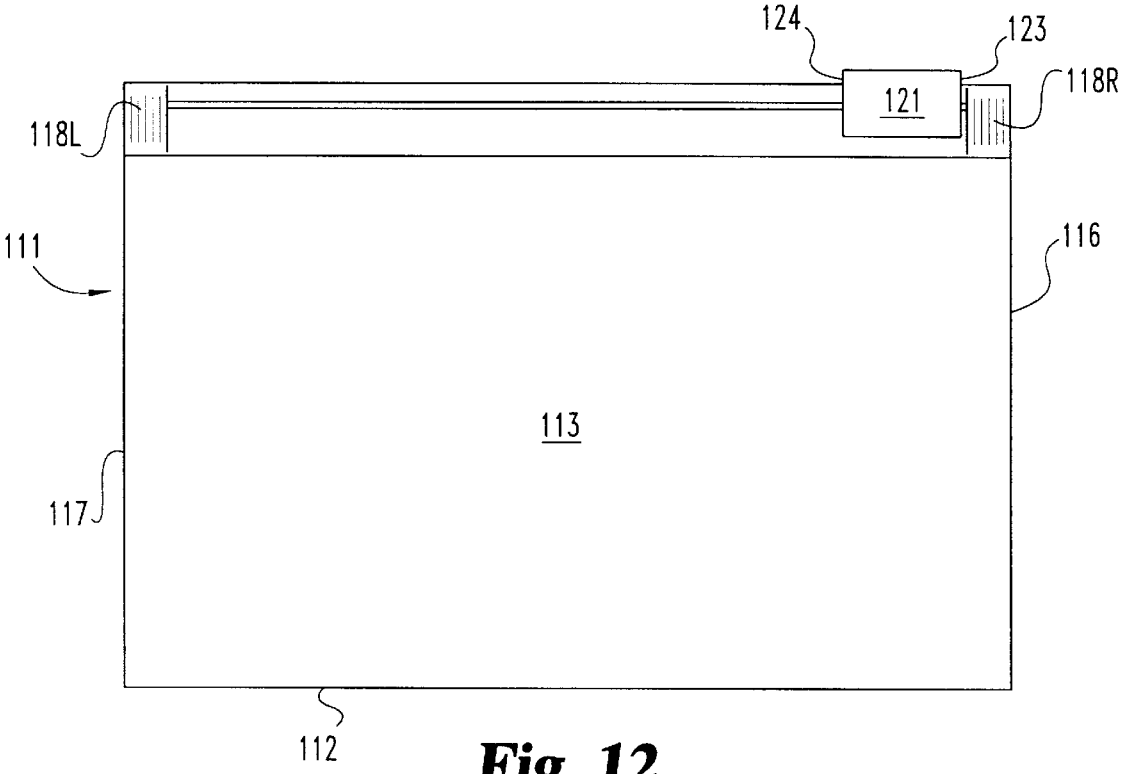
FIG. 12 is a front elevational view of a reclosable plastic bag with a zipper assembly according to another embodiment of the present invention.

Slider 21 is mounted on the strips 18 and 19. It includes a tunnel 22 of generally rectangular cross-sectional configuration extending lengthwise through it from an entrance end 23 to an exit end 24, the entrance and exit terminology referring to the relative direction of the track strip profile entering the entrance end 23 as the slider is moved to the right, and exiting end 24 as the slider is moved to the right in the direction of arrow 26 (FIG. 8) as the bag is closed. A slot 27 (FIGS. 4 and 11) in the bottom of the slider converges from the entrance end 23 to the exit end 24, as shown at 28 and 29 in FIG. 11. Likewise, the tunnel walls 31 and 32 converge in the same way between the entrance end 23 and exit end 24 of the slider. Therefore, as the slider is moved to the right in the direction of arrow 26, the open top of the bag is squeezed closed by the convergence of the walls 28 and 29 and 31 and 32 from the entrance end 23 to the exit end 24 of the tunnel.

Figure 2:
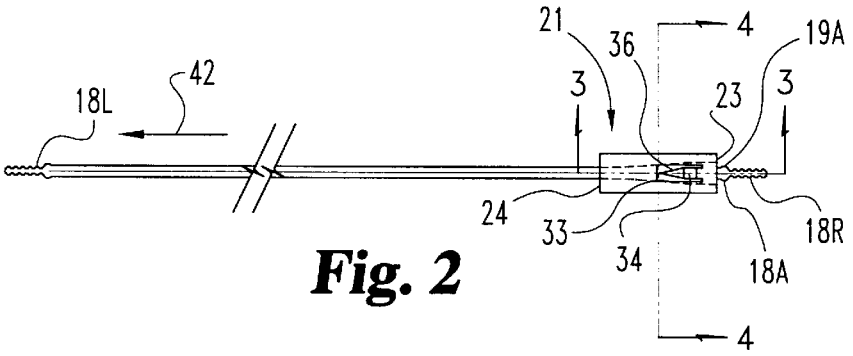
FIG. 2 is a top plan view thereof.
Figure 5:
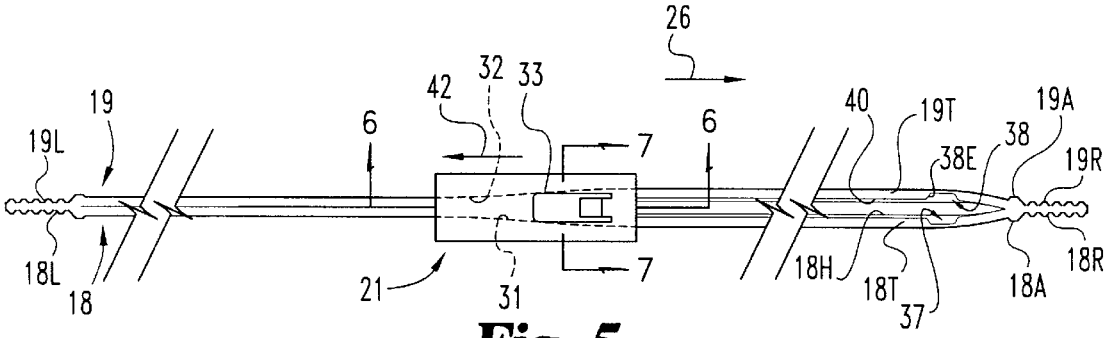
FIG. 5 is a top plan view of the bag assembly with the slider in position with the bag partially open.

As shown in FIG. 2, the top of the slider has an opening 33 therein that is partially closed by a separator tab 34 with a pointed portion 36 pointing in the same direction as walls 31 and 32 converge toward the exit end 24 of the slider. As shown in FIG. 5, the strip upper flanges have notches 37 and 38 therein. When the slider is in the bag-closed end stop position shown in FIGS. 1, 2, and 3, tab 34 projects into the notches and the pointed portion 36 extends down to a location touching the top 39 of the portion of the strip 19 profile which forms the groove 19G. A downwardly projecting guide post 41 in the slider extends down between the edges 18T and 19T. It serves two purposes. First of all, it very slightly spreads the edges of the slot near the entrance end 38E of the notch 38. It also serves as a stop to limit the movement of the slider in the bag opening direction of arrow 42, at the left-hand end where the bag is crimped at 18L so the slider will not slide off the end. Similarly it can serve as a stop at the right-hand end.

Figure 6:
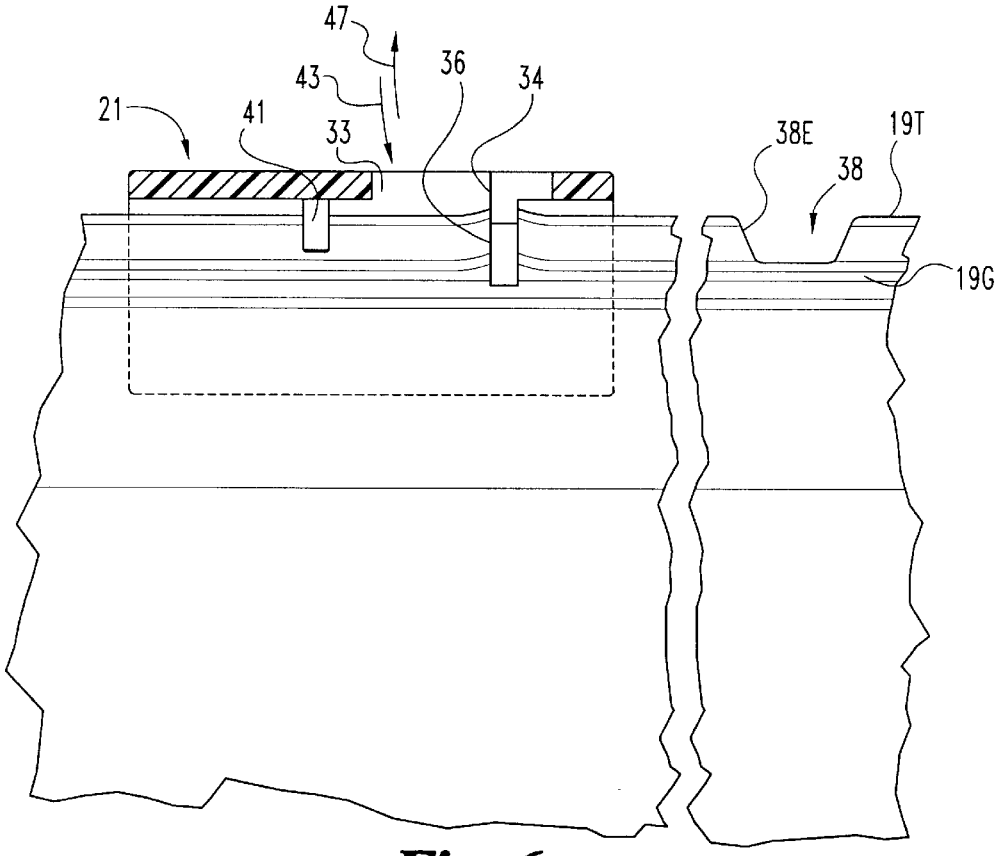
FIG. 6 is a sectional view through the slider and track assembly taken at line 6—6 in FIG. 5 and viewed in the direction of the arrows.
Figure 7:
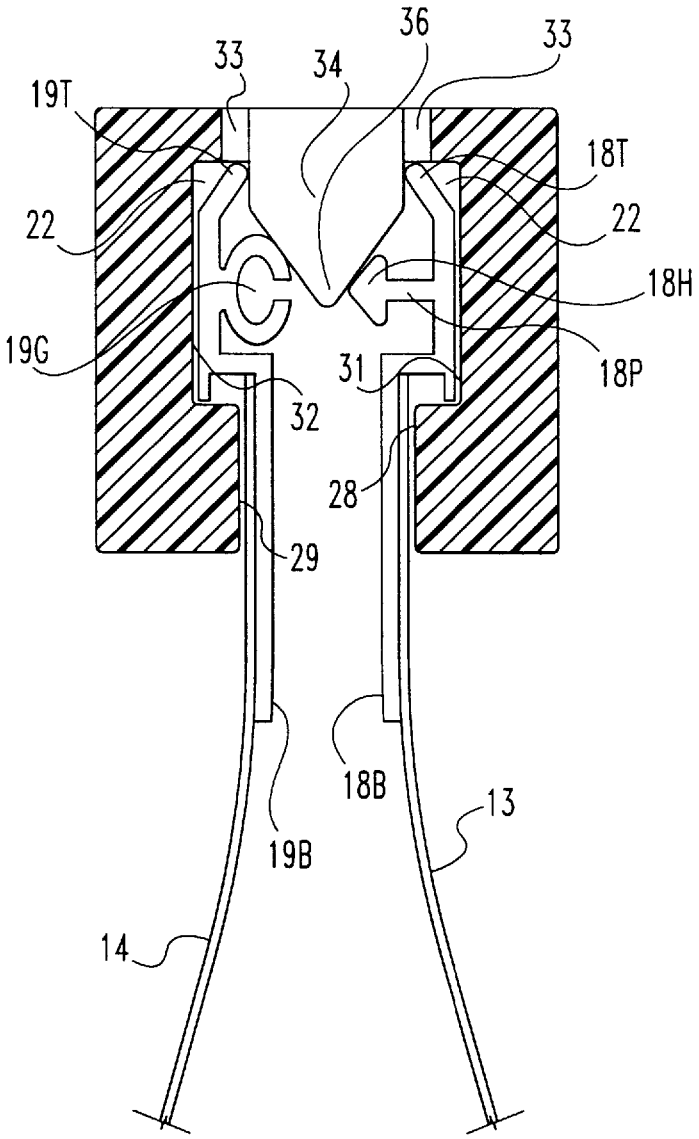
FIG. 7 is a much-enlarged cross sectional view thereof taken at line 7—7 in FIG. 5 and viewed in the direction of the arrows.

In the use of the assembly and starting with the bag closed as in FIGS. 1 through 4, the tab 34 is resting in the notch with its tip against the top 39 of the profile groove 19G portion. To open the bag, the slider is moved to the left in the direction of arrow 42. As it does so, the entrance edges 37E and 38E of the notches 37 and 38 in the upper flanges of the strips 18 and 19, are engaged by the sides of tab 34 and serve as cam surfaces which force the tab downward in the direction of arrow 43 to the position shown in FIGS. 5, 6 and 7, during which the point 36 is forced down on the top portion of the profile forming groove 19G and, sliding down on the curved surface 40 (FIG. 4) pushes that portion to the left in a direction away from the rib head 18H to separate these features as shown in FIG. 7 whereupon the bag is opened at this point. Further movement of the slider to the left in the direction of arrow 42 (FIG. 5) opens the rest of the bag top as shown at 46. When post 41 reaches the left-hand end of the bag where the strips 18 and 19 are crimped together, it stops the travel of the slider at that location.

Figure 3:
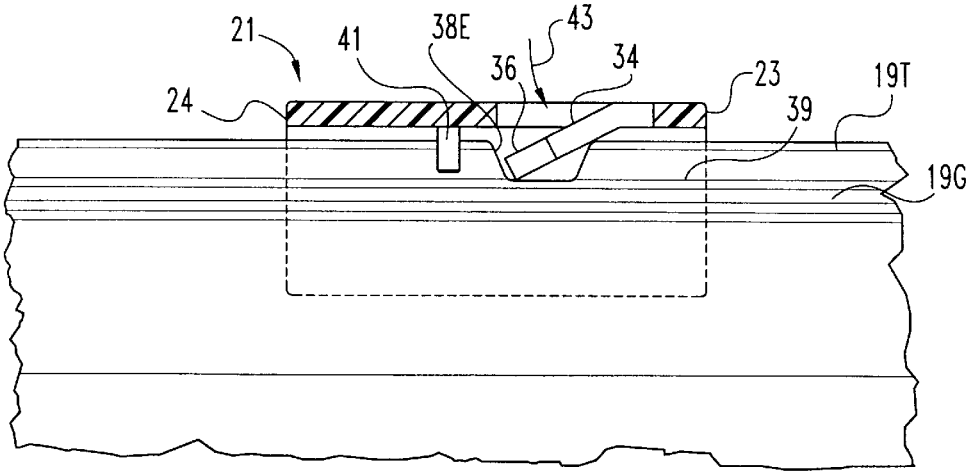
FIG. 3 is an enlarged section through the slider and track portion taken at line 3—3 in FIG. 2 and viewed in the direction of arrows and showing the slider in a bag-closed stop position.
Figure 8:
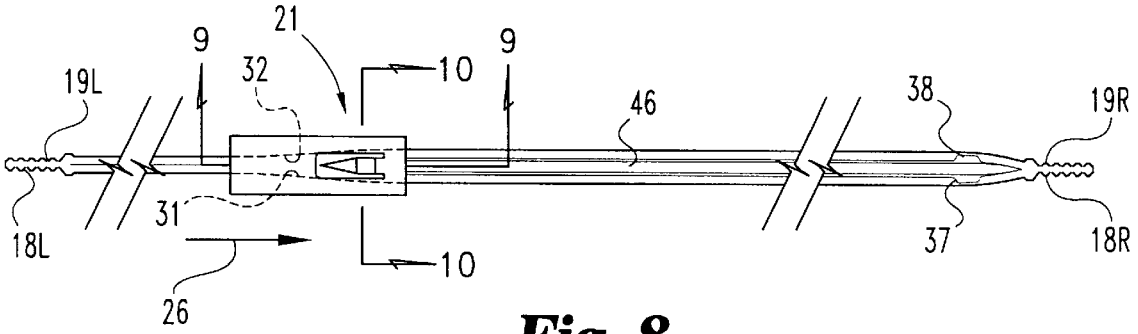
FIG. 8 is a top plan view of the bag assembly with the slider in a bag partially-open position but with the slider moving to the right toward the bag-closed stop position.
Figure 9:
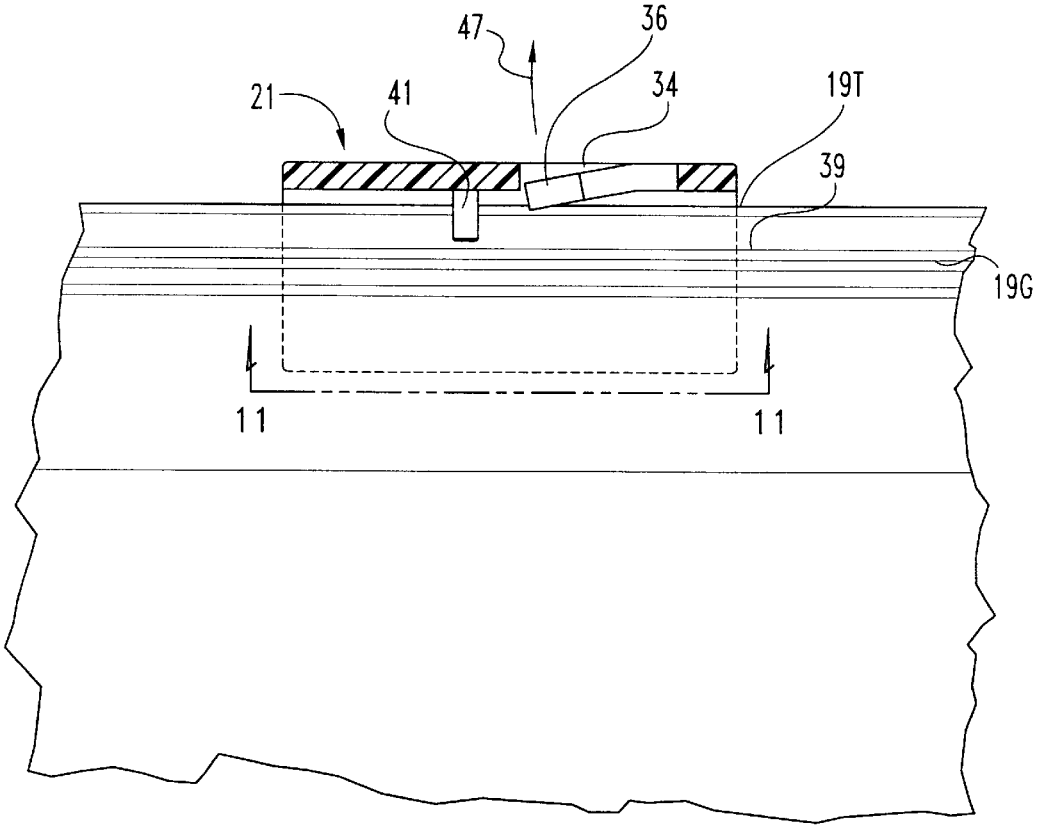
FIG. 9 is a sectional view therethrough taken at lines 9—9 in FIG. 8 and viewed in the direction of the arrows.
Figure 10:
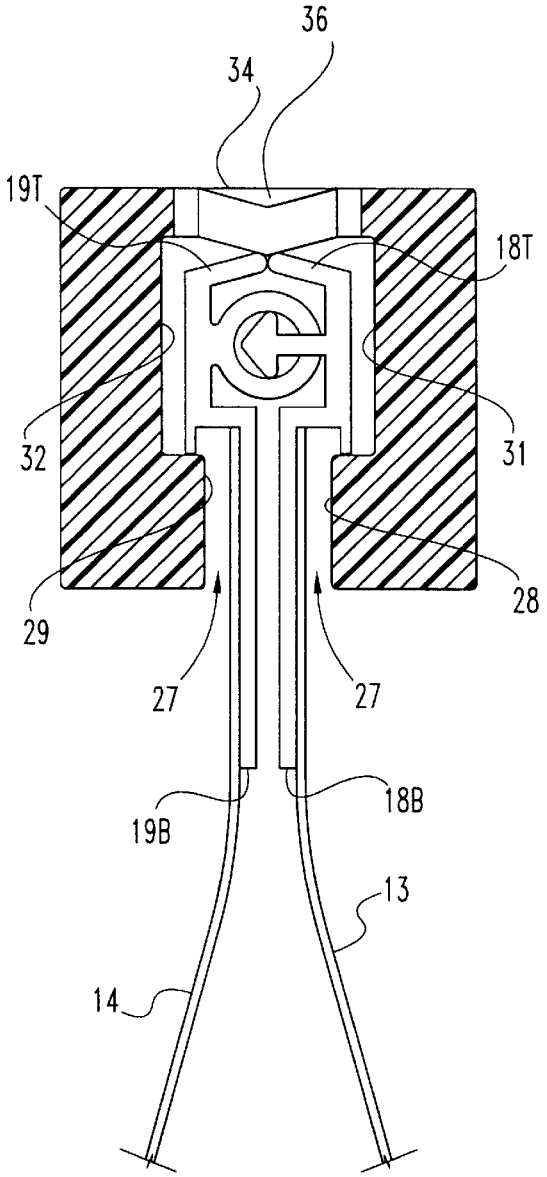
FIG. 10 is a much-enlarged cross sectional view taken at line 10—10 in FIG. 8 and viewed in the direction of the arrows.

To close the bag, the slider is gripped by the hand and pulled to the right in the direction of arrow 26 (FIG. 8). As it slides, engagement of the edges of the flanges 18T and 19T with the sides of the tab 34, tends to move the tab up in the clockwise direction of arrow 47 (FIG. 9) as the convergence of the tunnel walls 31 and 32 toward slider exit end 24 (FIG. 11) also squeezes the strips 18 and 19 together, such that the tab moves up to the location shown in FIGS. 9 and 10 where the point is riding on top of the upper inner edges of the flanges 18T and 19T, as shown in FIGS. 9 and 10. The tab will continue to ride in this position until the slider reaches the notch 38 at the bag-closed stop position of the slider, where the slider stops. At that point, the tab drops into the notch 38 to the position as shown in FIG. 3.

If the sound of the tab dropping into the notch is not sufficient to alert the user to stop pulling the slider, the fact that the slot 27 between slider walls 28 and 29 at the bottom of the slider extends inboard of the bottom edges 18L and 19L of the strips 18 and 19 to the base flanges 18B and 19B of the track strips, enables them to engage any abutment such as 18A or 19A which were formed at the end of each of the strips during the crimping closed thereof when the assembly is manufactured. Otherwise the pin 41 will stop the travel at the crimp of the upper edges 18T and 19T at the ends.

The disposition of the bottom slot walls 28 and 29 inboard of the outer bottom edges of the track strips at 18L and 19L, not only when the bag is closed, but also when the bag is open as in FIG. 7, prevents the slider from being pulled off the top of the strips and provides good vertical stability of the slider relative to the tracks at all times.

The material for the track strips is typically an extruded low density polyethylene. The material for the slider is typically a molded HMW plastic.

As indicated above, it is desirable that the tab 34 have a predisposition to descend into the notches 37 and 38 when the slider is moved into the bag-closed stop position shown in FIGS. 1–4. If the slider is molded in one step, with the tab 34 co-planar with the rest of the top of the slider, it may require a special molding technique to establish the predisposition for it to descend into the notch. It is also possible to mold the slider in two parts, with the tab being integral with the right-hand part and the opening 33 molded into the left-hand part, followed by ultrasonically or otherwise welding the two parts together. In this situation, the tab could be molded or separately attached such as to project downward into the notch or even into the space between the complementary rib and groove 18P and 19G as shown in FIGS. 6 and 7. The stop post 41 may be of metal or plastic driven into or through or molded or adhesively secured to the underside of the tunnel roof where shown in FIG. 3.

Figure 14:
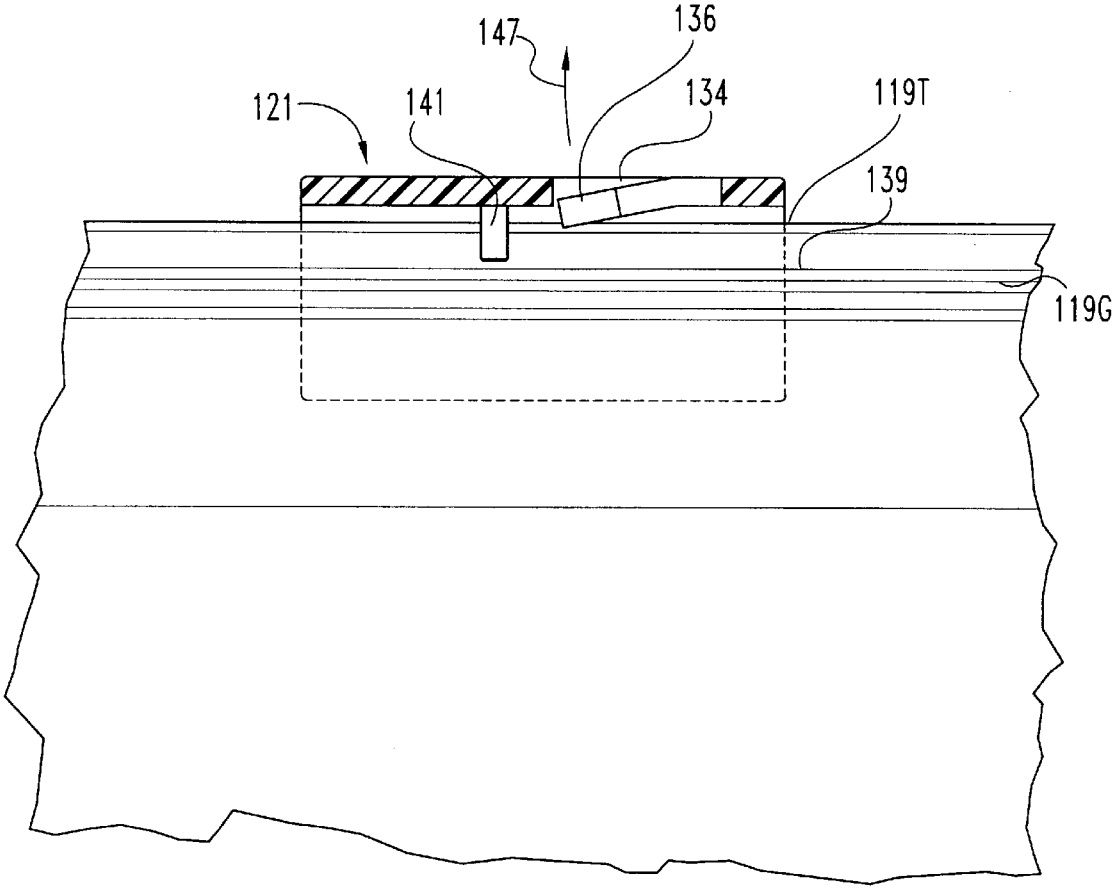
FIG. 14 is an enlarged sectional view taken at lines 14—14 in FIG. 13 and viewed in the direction of the arrows.
Figure 15:
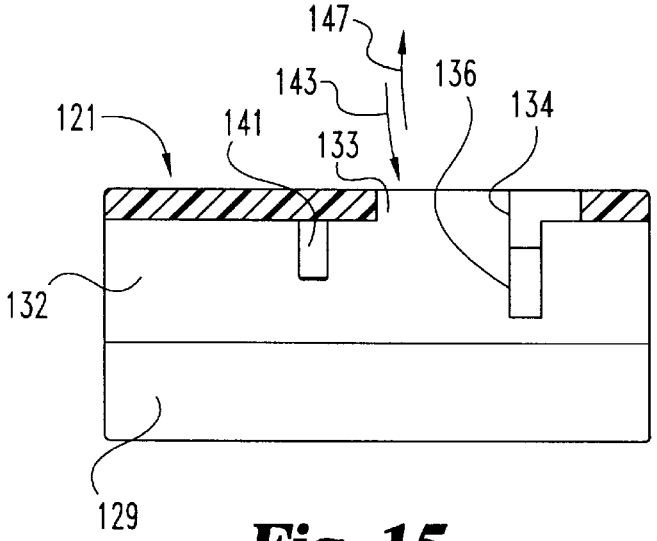
FIG. 15 is a further enlarged sectional view through the slider itself taken at the same cutting plane as FIG. 14 except with the slider separate from the bag as before installation on the bag.
Figure 16:
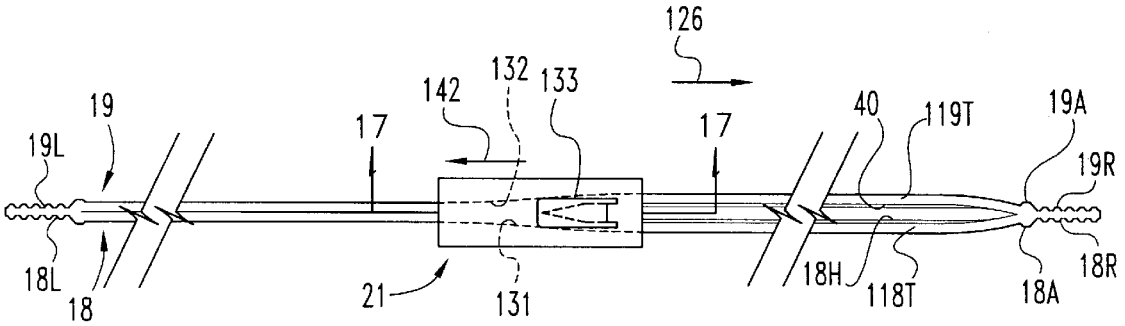
FIG. 16 is a top plan view of the bag assembly of FIGS. 12 and 13 but with the slider in position with the bag partially open.
Figure 17:
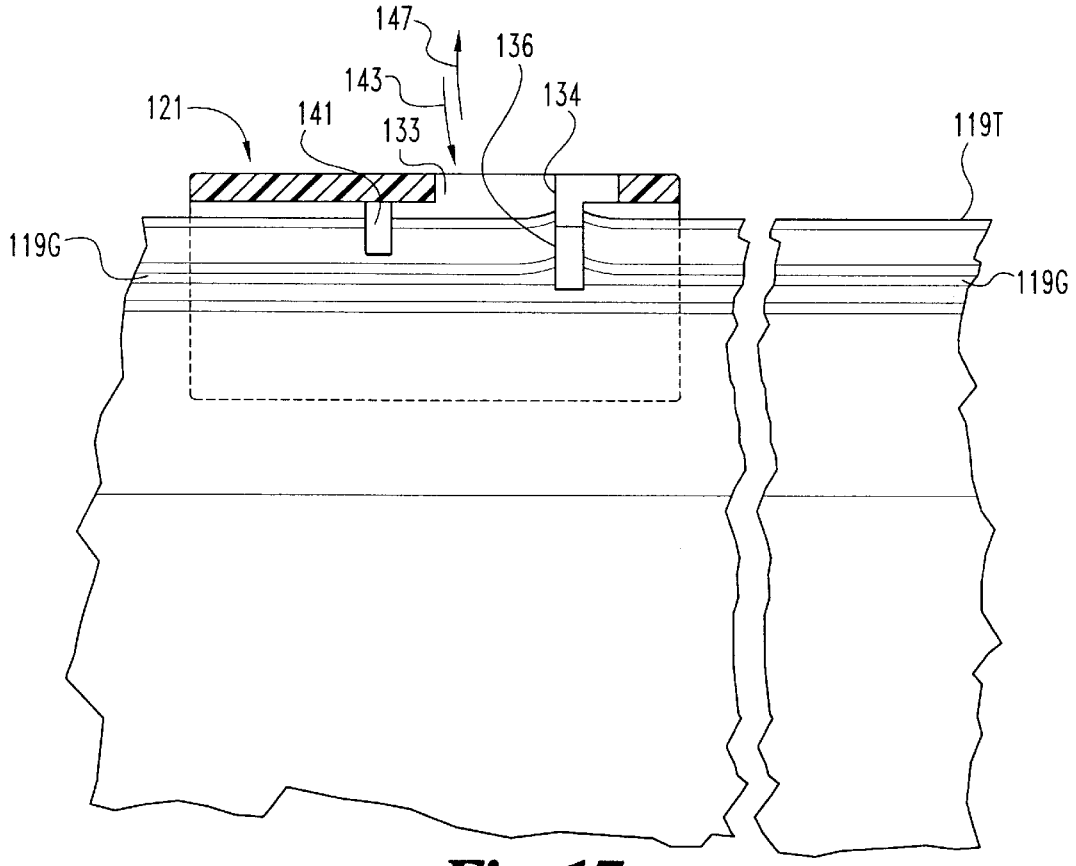
FIG. 17 is an enlarged sectional view through the slider and track assembly taken at line 17—17 in FIG. 16 and viewed in the direction of the arrows.

Referring now to FIGS. 12 through 17, components which are identical to or very similar to those in FIGS. 1 through 11 are given the same reference numerals but with a prefix "1". In this example, the bag 111 is like bag 11 except that the elongated flexible plastic strips 118 and 119 do not have the notch 38 in the top thereof. This is evident upon comparison of FIG. 5 with FIG. 16, and FIG. 6 with FIG. 17. Also, slider 121 is different in the respect that, in this embodiment, it is molded with the wedging tab 134, 136, perpendicular to the top of the tunnel, as shown in the sectional view of FIG. 15. The post 141 may be made and mounted as described for post 41. The material of the slider, being flexible and somewhat resilient, enables the tab 134, 136 to be resiliently pushed upward in the direction of arrow 147 to the position shown in FIG. 14 and dotted in FIG. 16, as the slider is moved in the bag-closing direction of arrow 126 (FIG. 16). When the tab is in this position, the tip of it rests atop the upper edges 118T and 119T of the strips 18 and 19, as shown for the previously described embodiment in FIG. 10. The side edges of the point converge in the same, bag-opening direction as slider walls 131 and 132, toward the exit end 124 of the slider. It is preferable that, as in the previously described embodiment, the post 141 not resiliently bend but, instead remain in the position shown in FIG. 14 between edges 18T and 19T, so it typically would be made of metal pressed into position through the top of the slider.

Figure 13:
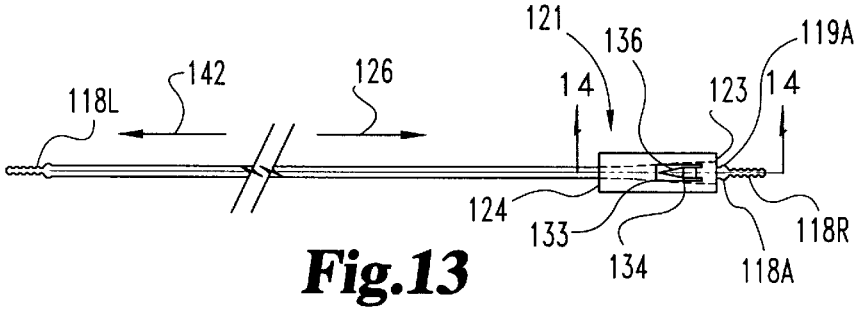
FIG. 13 is a top plan view of the FIG. 12 embodiment.

In this embodiment of the invention, when the slider is moved to the left in the bag-opening direction of arrow 142 from the bag-closed position shown in FIG. 13, and although the tab 134, 136 may be resting atop the top flanges 18T and 19T, it is stressed out of its normal molded unstressed position shown in FIG. 15 and tends to move downward. Therefore, with this and the point on the tab portion 136, it descends down between the upper flanges in the direction of arrow 143 and continues to push down to open the bag as in the previously described embodiment where the tab is cammed downward by the notch edges. This latter embodiment is the preferred embodiment because the guide strips 18 and 19 are easier to manufacture without the notch, enabling higher production and less scrap. Also, when the slider is moved in the direction of arrow 126 to the closed position, it can move completely out of not only the space between the tongue and groove 18H and 19G (FIG. 4), but also out of the space between the upper flanges to the position as shown in FIGS. 10 and 14.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a reclosable bag having first and second walls and an open top defined by first and second elongate flexible strips attached to the first and second walls, respectively, adjacent the top of the walls, one of the strips having a profile portion forming a groove and the other strip having a profile portion forming a rib with a portion of the rib received and retained in the groove when the bag top is closed, each of the strips having a base connected to the respective wall and each of the strips having an upper edge adjacent the upper edge of the other strip, and the bag having a slider mounted on the strips and movable in one direction longitudinally of the strips to progressively separate the rib from the groove to open the bag, and the slider being movable in the opposite direction to progressively return the rib portion to retained condition in the groove to close the bag, and the slider having a top, the improvement comprising:

a separator movably situated in the slider and having a proximal portion adjacent the top of the slider and hinged to the slider and having a distal portion residing in a first space between the top of the slider and the upper edges when the rib portion is retained in the groove of the groove-forming profile;

the separator distal portion being movable from the first space into position between the rib and the groove to separate the rib from the groove as the slider moves in the one (bag-opening) direction, but movable out of position between the rib and the groove as the slider is moved in the opposite (bag-closing) direction to permit closure of the bag.

2. The improvement of claim 1 and wherein:

the separator is hinged to be pivotably movable within the slider.

3. The improvement of claim 1 and wherein:

the slider is integral with the separator and is made of one integral homogenous unit of plastic.

4. The improvement of claim 1 and wherein:

each of the strips has an upper outside wall parallel to the upper outside wall of the other strip, and a flange turned inwardly from the wall and terminating at the said upper edge.

5. The improvement of claim 1 and wherein:

the strips have opposite ends;

the upper edges of the strips are fixed together at the ends of the strips but the upper edge of the one strip touches but is not fixed to the upper edge of the other strip at locations between the ends;

a post projects from the slider to a location between the upper edges to abuttingly engage the strips where the upper edges are fixed together at one end of the strips to limit the movement of the slider along the strips.

6. The improvement of claim 1 and further comprising:

a notch in the upper edge of at least one of the strips at one location along the upper edge;

the separator distal portion being pivotably movable into the notch when the slider is moved to position placing the distal portion in registry with the notch, and whereupon the distal portion resides in the notch when in registry with the notch and the head is retained in the groove.

7. The improvement of claim 6 and wherein:

the notch has an entrance end; and there is a cam surface at the entrance end oriented to deflect the separator upon movement of the slider from the notch in the one bag-opening direction and thereby move the distal portion into position between the head and the groove to separate the head from the groove as the slider moves in the one direction, but pivotable out of the position between the head and groove as the slider is moved in the opposite bag-closing direction to permit closure of the bag.

8. The improvement of claim 7 and wherein:

the slider has first and second travel-end stop positions on the strips, the first stop position being the bag-closed stop position, and the second being the bag-opened stop position; and the notch is located at the bag-closed stop position.

9. The improvement of claim 7 and wherein:

the notch has two ends, one end being nearer to the bag-open stop position than the other end;

the notch entrance end being the one end and located in the path of the distal portion of the separator as the slider is moved from the bag-closed stop position toward the bag-open stop position to thereby cam the distal portion down into position between the head and the groove.

10. The improvement of claim 1 and wherein:

the rib has a head received and retained in the groove when the bag is closed;

the slider is made of a resilient material and has a top surface; and the separator is formed in the top surface and is resiliently pivotable relative to the top surface between position of the distal portion in the space and position of the distal portion between the head and the groove.

11. A bag closure assembly comprising:

first and second elongate flexible strips securable to marginal portions of a bag opening, one of the strips having a profile portion forming a groove and the other strip having a profile portion forming a rib with a portion received and retained in the groove to hold the strips together, each of the strips having an upper edge adjacent the upper edge of the other strip;

a slider mounted on the strips and movable in one direction longitudinally of the strips to progressively separate the rib from the groove to separate the strips, and the slider being movable in the opposite direction to progressively return the rib portion to retained condition in the groove to join the strips;

a separator movably situated in the slider and having a proximal portion hinged to the slider and having a distal portion residing in a first space above the upper edges when the rib portion is retained in the groove;

the separator distal portion being movable from the first space into position between the rib and the groove to separate the retained portion from the groove as the slider moves in the one direction to separate the strips, but movable out of a position between the rib and the groove as the slider is moved in the opposite direction to permit rejoining of the strips.

12. The improvement of claim 11 and wherein;

the separator is hinged to be pivotably movable within the slider.

13. The improvement of claim 11 and wherein:

the slider is integral with the separator and is made of one integral homogenous unit of plastic.

14. The improvement of claim 11 and wherein:

each of the strips has an upper outside wall parallel to the upper outside wall of the other strip, and a flange turned inwardly from the wall and terminating at the said upper edge.

15. The improvement of claim 14 and wherein:

the upper edge of the one strip touches the upper edge of the other strip, and the first space is closed at the bottom by the touching edges.

16. The improvement of claim 11 and wherein:

the separator has a point at its distal end for entering between the touching edges of the strips and pivoting downward to separate the rib from the groove when the slider is moved in the one direction, thereby wedging the strips apart.

17. The improvement of claim 16 and wherein:

the point is formed by sides of the separator; and the slider has interior walls that converge to squeeze the strips together when the slider is moved in said opposite direction; and the point and the walls converge in the said one direction.

18. The improvement of claim 11 and wherein:

the strips have opposite ends;

the upper edges of the strips are fixed together at the ends of the strips but the upper edge of the one strip touches but is not fixed to the upper edge of the other strip at locations between the ends;

a post projects from the slider to a location between the upper edges.

19. The improvement of claim 18 and wherein:

the post is a metal pin and is located in the one direction from the point such that the point points toward the pin and the pin serves as a guide as the slider is moved in the one direction along the strips.

20. The improvement of claim 11 and further comprising:

a notch in the upper edge of at least one of the strips at one location along the upper edge;

the separator distal portion being pivotably movable into the notch when the slider is moved to position placing the distal portion in registry with the notch, and whereupon the distal portion resides in the notch when in registry with the notch and the head is retained in the groove.

21. The improvement of claim 20 and wherein:

the notch has an entrance end; and there is a cam surface at the entrance end oriented to deflect the separator upon movement of the slider from the notch in the one direction and thereby move the distal portion into position between the head and the groove to separate the head from the groove as the slider moves in the one direction, but pivotable out of the position between the head and groove as the slider is moved in the opposite direction.

22. The improvement of claim 21 and wherein:

the slider is made of a resilient material and has a top surface; and the separator is formed in the top surface and is resiliently pivoted down from the top surface into position of the distal portion between the head and the groove, and normally tends to return toward the top surface.

23. A method of opening a zipper-type plastic bag closure assembly and comprising the steps of:

providing a bag closure assembly comprising two elongate bag-closing zipper strips having interlocking features to keep the strips together for closing a bag to which the strips are securable for bag closure; and providing on the strips a slider having a separator, with the slider being slidable along the strips from a position thereon during which the strips are interlocked together, to a position thereon in which the strips are separated throughout a portion of their length; and moving the slider from a bag-closed stop position on the bag-closing zipper strips, in a bag-opening direction; and pivoting the separator in the slider into position between interlocking features of the strips to separate the strips as the slider is moved in the bag-opening direction.

24. The method of claim 23 and wherein the step of pivoting the separator includes:

camming the separator downward within the slider by engagement of the separator by camming edges of the strips.

25. The method of claim 24 and wherein the step of pivoting the separator comprises:

resiliently moving a portion of the slider.

26. The method of claim 23 and wherein the step of pivoting the separator includes:

wedging a point on the separator between upper edges of the strips while moving the slider in the bag-opening direction and pivoting the separator downward to separate the strips.

27. The method of claim 26 and further comprising the step of:

using resilient bias of the slider material to assist in the downward pivoting of the separator.

28. The method of claim 26 and further comprising the step of:

guiding the slider along the strips with a guide post of the slider located between the upper edges of the strips ahead of the separator in the bag-opening direction.

* * * * *